US011719424B1

(12) United States Patent
Tang

(10) Patent No.: US 11,719,424 B1
(45) Date of Patent: Aug. 8, 2023

(54) LED FILAMENT LAMP HAVING A MEMORY FUNCTION

(71) Applicant: Dongliang Tang, Pingxiang (CN)

(72) Inventor: Dongliang Tang, Pingxiang (CN)

( * ) Notice: Subject to any disclaimer, the term of this patent is extended or adjusted under 35 U.S.C. 154(b) by 0 days.

(21) Appl. No.: 18/091,229

(22) Filed: Dec. 29, 2022

(51) Int. Cl.
*F21V 23/00* (2015.01)
*F21K 9/275* (2016.01)
*F21V 19/00* (2006.01)
*F21Y 115/10* (2016.01)

(52) U.S. Cl.
CPC ..... *F21V 23/003* (2013.01); *F21K 9/275* (2016.08); *F21V 19/001* (2013.01); *F21V 23/002* (2013.01); *F21Y 2115/10* (2016.08)

(58) Field of Classification Search
CPC .... F21V 23/003; F21V 19/001; F21V 23/002; F21K 9/275
See application file for complete search history.

(56) References Cited

U.S. PATENT DOCUMENTS 7,352,138 B2 * 4/2008 Lys ..... H05B 45/3725 315/DIG. 4
8,188,671 B2 * 5/2012 Canter ..... H05B 45/375 315/307
8,540,401 B2 * 9/2013 Simon ..... F21V 23/009 362/373
8,541,933 B2 * 9/2013 Chowdhury ..... F21K 9/232 362/555
8,680,755 B2 * 3/2014 Lim ..... H05B 33/02 362/373
8,686,623 B2 * 4/2014 Wheelock ..... F21V 3/00 362/373
9,097,412 B1 * 8/2015 Pinato ..... F21V 29/70
9,194,556 B1 * 11/2015 Nelson ..... F21V 3/00
9,234,655 B2 * 1/2016 Progl ..... F21V 29/85
2009/0195186 A1 * 8/2009 Guest ..... H05B 45/3577 313/11
2019/0364634 A1 * 11/2019 Shan ..... G09F 21/042

* cited by examiner

*Primary Examiner* — Bryon T Gyllstrom
(74) *Attorney, Agent, or Firm* — Daniel M. Cohn; Howard M. Cohn

(57) ABSTRACT

An LED filament lamp having a memory function includes a bulb shell, a lamp cap, a stem, LED light strips and a driver. The lamp cap is disposed on the bulb shell, and the lamp cap and the bulb shell encircle to form an accommodating cavity. The stem is disposed in the accommodating cavity, and the stem has three lead wires. The LED light strips are disposed on the stem are connected to the three lead wires. The driver is disposed in the lamp cap and the drive is connected to the three lead wires. By setting a receiving module and a dimming and toning IC on the drive, color temperature may be adjusted by powering on or off the switch, brightness and colors of the LED filament lamp may be adjusted by a remote controller transmitting 2.4 GHz signals.

5 Claims, 2 Drawing Sheets

LED FILAMENT LAMP HAVING A MEMORY FUNCTION

TECHNICAL FIELD

The subject matter herein generally relates to a technical field of lamps, and in particular to an LED filament lamp having a memory function, which controls dimming and color toning by a remote control method and changes color by a switch.

BACKGROUND

With the development of Light Emitting Diode (LED) filament lamps and market needs, the LED filament lamps with functions, such as dimming products, Wireless Fidelity (WiFi) products, light sensing products are gradually accepted by the market, and types of the dimming products include a dimmer dimming and a switch dimming It is necessary to add a dimmer to perform a dimming function for users using a product of dimmer dimming, which is costly, and lines of the product need to be disposed in advance when decorating, and it is necessary to move a position of the dimmer to operate the dimmer when using the product. The WiFi products are limited by home routers, a network used by the WiFi products is often offline or unable to connect to the WiFi products, and the network is vulnerable to network attacks. However, there is no need of a dimmer for a dimming product controlled by a remote controller, a switch is used to adjust color temperature in sections, and the remote controller adjusts the color temperature and brightness. The remote controller uses a local area network and may not be affected by the Internet.

Currently, filament lamp products using infrared remote controllers are available on the market, but the filament lamp products using the infrared remote controllers must use invisible infrared light to support work, which is easily affected by distance, usage scenarios, obstructions, infrared receiving modules, etc., and is very inconvenient to use.

SUMMARY

Based on above, the present disclosure provides an LED filament lamp having a memory function, to solve above technical problem that an existing LED filament lamp is inconvenient to use.

To achieve the above purpose, the present disclosure provides the following technical scheme.

The present disclosure provides an LED filament lamp having a memory function, including a bulb shell, a lamp cap, a stem, LED light strips, and a driver. The lamp cap is disposed on the bulb shell, and the lamp cap and the bulb shell encircle to form an accommodating cavity, and the stem is disposed in the accommodating cavity, and the stem has three lead wires, the LED light strips are disposed on the stem and are connected to the three lead wires, the driver is disposed in the lamp cap and the driver is connected to the three lead wires, a rectification and filter circuit is disposed in the driver, and the rectification and filter circuit is connected to an alternating current (AC) of the external power supply; a power supply module, a receiving module, a dimming and toning integrated circuit (IC) and an AC detection circuit are disposed on a rectification rear end of the rectification and filter circuit.

Furthermore, the bulb shell is welded with the stem by a sealing process to form a sealed accommodating cavity, the sealed accommodating cavity is filled with inert gases with high thermal conductivity or mixed gases of inert gases and oxygen.

Furthermore, an exhaust pipe is disposed on the stem.

Furthermore, the rectification and filter circuit includes a resistor, a bridge stack and an electrolytic capacitor. The resistor, the bridge stack and the electrolytic capacitor are connected in sequence.

Furthermore, the LED light strips are disposed on the stem according to colors, and electrode terminals of the LED light strip are connected to the three lead wires on the stem.

Compared with the prior art, the present disclosure has obvious advantages and beneficial effects. Specifically, in the above technical scheme, by setting the receiving module and the dimming and toning IC on the driver, the colors may be adjusted by powering on or off the switch, and the colors and brightness of the LED filament lamp may be adjusted by a remote controller transmitting 2.4 GHz signals, therefore realizing an adjustment of a light bulb without being disturbed by using environment under wireless transmission conditions; when the light bulb is started next time, the light bulb may keep the brightness and the colors of a state when the light was turned off last time. At the same time, the remote controller may be switched arbitrarily, realizing that one LED filament lamp corresponds to one remote controller, one LED filament lamp corresponds to multiple remote controllers, and one remote controller corresponds to multiple LED filament lamps, and the remote controller may be grouped to control different LED filament lamps, bringing using convenience.

BRIEF DESCRIPTION OF THE DRAWINGS

Implementations of the present disclosure will now be described, by way of example only, with reference to the attached figures.

Figure 1:
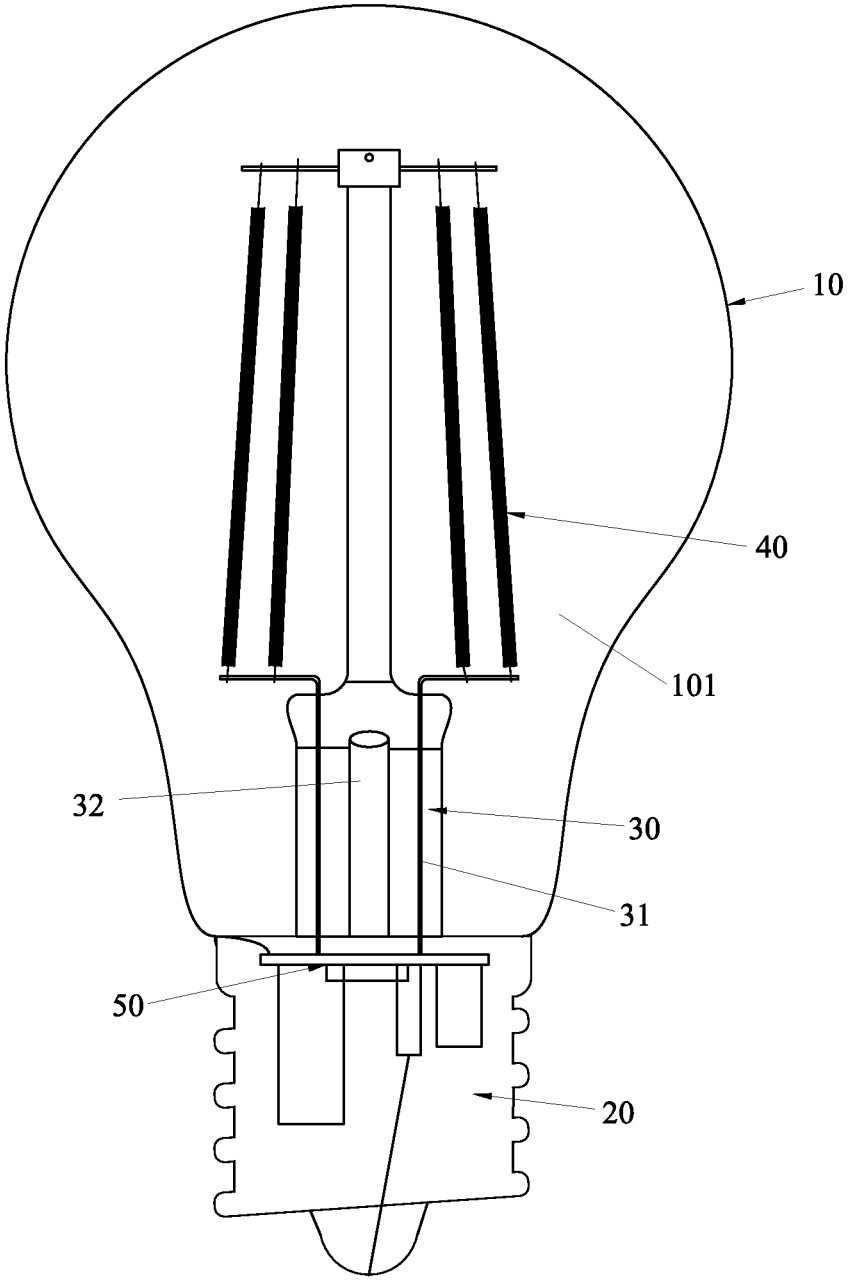
FIG. 1 is a structural schematic of an exemplary embodiment of an LED filament lamp of the present disclosure.

Reference numbers in the drawings: 10. bulb shell; 20. lamp cap; 30. stem; 31. lead wire; 32. exhaust pipe; 40. LED light strip; 50. driver; 51. rectification and filter circuit; 52. power supply module; 53. receiving module; 54. dimming and toning IC; 55. AC detection circuit; 60. remote controller; 101. accommodating cavity.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

The term "comprising" means "including, but not necessarily limited to"; it specifically indicates open-ended inclusion or membership in a so-described combination, group, series and the like.

Exemplary embodiments of the present disclosure will be described in relation to the accompanying drawings.

Figure 2:
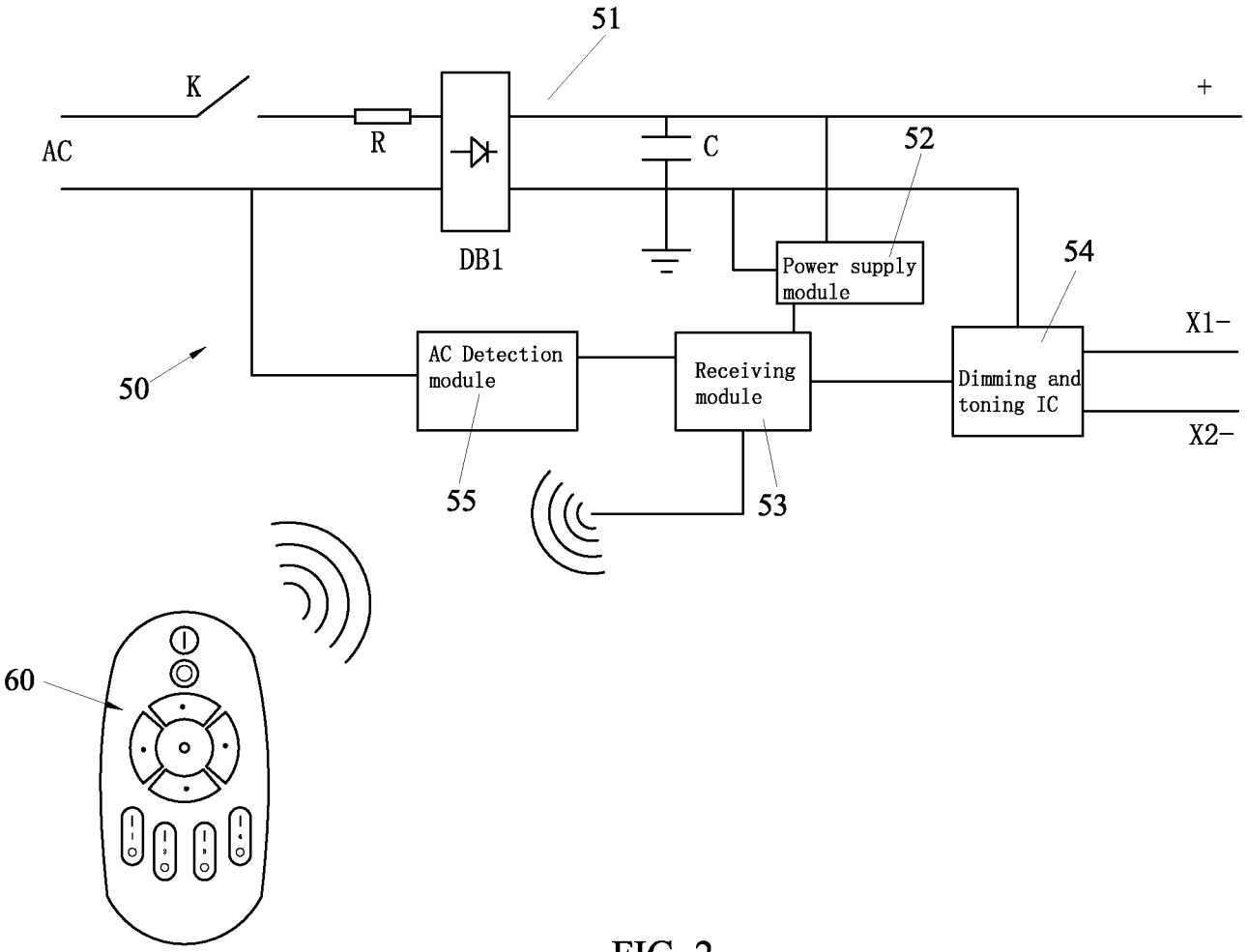
FIG. 2 is a structural schematic of an exemplary embodiment of a driver of the present disclosure.

FIGS. 1-2 illustrate an exemplary embodiment of an LED filament lamp. In one embodiment, the LED filament lamp includes a bulb shell 10, a lamp cap 20, a stem 30, LED light strips 40, and a driver 50.

The lamp cap 20 is disposed on the bulb shell 10. The lamp cap 20 and the bulb shell 10 encircle to form an accommodating cavity 101. The stem 30 is disposed in the accommodating cavity 101, and the stem 30 has three lead wires 31. The LED light strips 40 are disposed on the stem 30. The LED light strips 40 are connected to the three lead wires 31. In one embodiment, the bulb shell 10 is welded with the stem 30 by a sealing process to form a sealed accommodating cavity. The sealed accommodating cavity 101 is filled with inert gases with high thermal conductivity or mixed gases of inert gases and oxygen. An exhaust pipe 32 is disposed on the stem 30. The LED light strips 40 are respectively disposed on the stem 30 according to colors. Electrode terminals of the LED light strips 40 are connected to the three lead wires 31 on the stem 30.

The driver 50 is disposed in the lamp cap 20, and the driver 50 is connected to the three lead wires. The driver 50 is connected to an external power supply by the lamp cap 20. A rectification and filter circuit 51 is disposed in the driver 50 and is connected to an alternating current (AC) of the external power supply. A power supply module 52, a receiving module 53, a dimming and toning integrated circuit (IC) 54, and an AC detection circuit 55 are disposed on a rectification rear end of the rectification and filter circuit 51. The rectification and filter circuit 51 includes a resistor R, a bridge stack DB1 and an electrolytic capacitor C. The resistor R, the bridge stack DB1, and the electrolytic capacitor C are connected in sequence.

During a process of assembling the LED filament lamp, the LED light strips 40 are disposed on the stem 30, and the electrode terminals of the LED light strips 40 are connected to the three lead wires 31 on the stem 30, and the bulb shell 10 is welded with the stem 30 by the sealing process to form the sealed accommodating cavity, after an exhausting and inflating process, required gases are filled into the sealed accommodating cavity 101 by the exhaust pipe 32 on the stem 30, and then the exhaust pipe 32 is sintered and sealed, and the three lead wires 31 of the stem 30 are connected to the driver 50, and the driver 50 supplies power to the LED light strips 40. The driver 50 is disposed inside the lamp cap 20 and is electrically connected to the external power supply by the lamp cap 20.

In one embodiment, the driver 50 has multiple output states, including that when the external power supply is turned on/off to control the output states of the driver 50, after a switch is powered on twice continuously, the driver 50 outputs power to a first circuit X1; when the switch is powered on after powering off the switch, the driver 50 outputs power to a second circuit X2; when the switch is twice powered on after powering off the switch, the driver 50 outputs power to the first circuit X1 and the second circuit X2 at the same time. In one embodiment, when the driver 50 is powered on again after the driver 50 has been powered off for more than 7 seconds, the output state of the driver 50 is an output state when it was last powered off. When using a remote controller 60 to adjust brightness and colors, the remote controller 60 sends instructions. The receiving module 53 of the driver 50 receives the instructions, and correspondingly adjusts the current of the dimming and toning IC 54 according to the instructions to realize the adjustment of the colors and the brightness. In one embodiment, the receiving module 53 may be a 2.4 G receiving module for receiving 2.4 GHz signals. In one embodiment, before the remote controller 60 sends another instruction and the switch does not change a control mode more than twice consecutively, the power is turned on after the power is turned off, if the driver 50 is powered on again after the driver 50 is powered off, the driver 50 may save an output state when it was powered off last time. The lamp cap 20 is connected to the sealed accommodating cavity by a welding paste.

Referring to FIG. 2, an AC input terminal is connected to the external alternating current. The resistor R and the bridge stack DB1 are disposed to connect to the AC input terminal for protecting and rectifying the driver 50. The electrolytic capacitor C is disposed to connect to bridge stack DB1 for filtering.

The receiving module 53 is disposed at a front end of the dimming and toning IC 54. The dimming and toning IC 54 has two control methods, and one control method is a method of controlling the dimming and toning IC 54 by a switch K, the other control method is a method of controlling the dimming and toning IC 54 by the remote controller 60.

When a power switch (for example, switch K) is powered off twice in a row and then powered on again, the dimming and toning IC 54 outputs signal or power to the first circuit X1. When the power switch is powered on again after the power switch has been powered off for more than 7 seconds, the dimming and toning IC 54 outputs signal or power to the second circuit X2. When the power switch is powered on again after the power switch has been powered off for more than 7 seconds, the dimming and toning IC 54 outputs signal or power to the first circuit X1 and the second circuit X2.

After the remote controller 60 transmits a signal, the receiving module 53 receives the signal from the remote controller 60, and transmits the signal to the dimming and toning IC 54. The dimming and toning IC 54 adjusts the current according to an instruction of the signal to adjust the brightness, and adjusts the colors by adjusting the first circuit X1 or the second circuit X2. A positive pole is connected to a positive pole of the LED filament lamp, and a negative pole is connected to a negative pole of the LED filament lamp.

The key points of the present disclosure are as following: by setting the receiving module and the dimming and toning IC on the driver, the colors are adjusted by powering on or off the switch, and the colors and brightness of the LED filament lamp are adjusted by a remote controller transmitting 2.4 GHz signals, therefore realizing an adjustment of a light bulb without being disturbed by using environment under wireless transmission conditions; when the light bulb is started next time, the light bulb may keep the brightness and the colors of a state when the light was turned off last time. At the same time, the remote controller may be switched arbitrarily, realizing one LED filament lamp corresponds to one remote controller, one LED filament lamp corresponds to multiple remote controllers, and one remote controller corresponds to multiple LED filament lamps, and the remote controllers may be grouped to control different LED filament lamps, bringing using convenience.

The technical principles of the present disclosure have been described above in conjunction with specific embodiments. The above descriptions are only for explaining the principles of the present disclosure, and cannot be construed as limiting a protection scope of the present disclosure. Based on the above explanations, those skilled in the art can think of other specific embodiments of the present disclosure without creative work, and the specific embodiments will all fall within the protection scope of the present disclosure.

What is claimed is:

1. An LED filament lamp having a memory function, comprising:

a bulb shell;

a lamp cap;

a stem;

LED light strips; and a driver;

wherein the lamp cap is disposed on the bulb shell, the lamp cap and the bulb shell encircle to form an accommodating cavity, the stem is disposed in the accommodating cavity, and the stem has three lead wires; the LED light strips are disposed on the stem and are connected to the three lead wires, the driver is disposed in the lamp cap and the drive is connected to the three lead wires, the driver is connected to an external power supply by the lamp cap, a rectification and filter circuit is disposed in the driver, and the rectification and filter circuit is connected to an alternating current (AC) of the external power supply; a power supply module, a receiving module, a dimming and toning integrated circuit (IC) and an AC detection circuit are disposed on a rectification rear end of the rectification and filter circuit.

2. The LED filament lamp having the memory function as recited in claim 1, wherein the bulb shell is welded with the stem by a sealing process to form a sealed accommodating cavity, the sealed accommodating cavity is filled with inert gases with high thermal conductivity or mixed gases of inert gases and oxygen.

3. The LED filament lamp having the memory function as recited in claim 2, wherein an exhaust pipe is disposed on the stem.

4. The LED filament lamp having the memory function as recited in claim 1, wherein the rectification and filter circuit comprises a resistor, a bridge stack, and an electrolytic capacitor; and the resistor, the bridge stack and the electrolytic capacitor are connected in sequence.

5. The LED filament lamp having the memory function as recited in claim 1, wherein the LED light strips are disposed on the stem according to colors, and electrode terminals of the LED light strips are connected to the three lead wires on the stem.

* * * * *